United States Patent [19]

Sunaoka

[11] Patent Number: 4,558,835

[45] Date of Patent: Dec. 17, 1985

[54] MULTI-BOBBIN WIRE COILING MACHINE AND JIG MOUNTING MECHANISM THEREFOR

[76] Inventor: Seiichi Sunaoka, 3570 Oaza Bijogi, Toda-shi, Saitama-Ken, Japan

[21] Appl. No.: 395,971

[22] Filed: Jul. 7, 1982

[51] Int. Cl.[4] ..... H01F 41/06

[52] U.S. Cl. ..... 242/7.09; 242/7.11; 242/7.14; 140/92.1

[58] Field of Search ..... 242/7.09, 7.11, 7.14, 242/7.18; 140/92.1

[56] References Cited

U.S. PATENT DOCUMENTS

| | | | |
|---|---|---|---|
| 3,101,180 | 8/1963 | Sadorf | 242/7.11 X |
| 3,658,269 | 4/1972 | Giuseppe | 242/7.11 X |
| 4,157,165 | 6/1979 | Bierman et al. | 242/7.14 X |

*Primary Examiner*—Donald Watkins
*Assistant Examiner*—David Werner
*Attorney, Agent, or Firm*—Frishauf, Holtz, Goodman & Woodward

[57] ABSTRACT

A multi-bobbin wire coiling machine in which an indexing jig mounting mechanism is mounted on a vertical rotary shaft adapted to be intermittently rotated for rotation therewith, a plurality bobbin mounting jigs are supported on the jig mounting mechanism in vertically spaced relationship to each other in the longitudinal direction of the mechanism, a plurality of bobbins mounted in the jigs and a plurality of flyers surrounding the bobbins to coil wires about the bobbins.

In one embodiment, the jig mounting mechanism comprises a plurality of tables mounted on the rotary shaft in vertically spaced relationship to each other in the longitudinal direction of the shaft, said tables each having a plurality of circumferentially spaced slots in the periphery, and a plurality of slide plates extending through said slots in the tables and each having a plurality of bobbin mounting means secured thereto in vertically spaced relationship to each other in the longitudinal direction of the associated slide plate.

In another embodiment, the jig mounting mechanism comprises a cylindrical standard mounted on the rotary shaft and having a plurality of circumferentially spaced slots in the periphery and a plurality of support bars extending within the slots in the standard and each having a plurality of bobbin mounting means secured thereto in vertically spaced relationship to each other in the longitudinal direction of the associated support bar.

8 Claims, 9 Drawing Figures

MULTI-BOBBIN WIRE COILING MACHINE AND JIG MOUNTING MECHANISM THEREFOR

BACKGROUND OF THE INVENTION

This invention relates to a novel and improved multi-bobbin wire coiling machine having flyers and more particularly, to a multi-bobbin wire coiling machine having flyers which is particularly adapted to simultaneously coil a plurality of wires with their one ends anchored to the bobbins, which accelerates the replacement of bobbin mounting jigs and which includes a novel and improved jig mounting mechanism.

A variety of wire coiling machines have been proposed and practically employed in order to coil wires about bobbins. In order to enhance the wire coiling efficiency in the wire coiling machine, a multi-bobbin wire coiling machine has been developed for mass production operation so that a plurality of wires are simultaneously coiled about bobbins. In the production of coiled wire products by the use of such a multi-bobbin wire coiling machine, when the jigs on which the bobbins are mounted are replaced the jigs have to be individually replaced and thus, the jig replacement operation in the multi-bobbin wire coiling machine is quite inefficient.

Furthermore, in order to cope with recent advances in the technology of low power and electronic appliances and increasing demand for such appliances, increasing varieties of coiled wire products have to be produced. Therefore, the conventional inefficient jig replacement operation inevitably impedes mass production of coiled wire products.

SUMMARY OF THE INVENTION

Therefore, one object of the present invention is to provide a novel and improved multi-bobbin wire coiling machine which effectively eliminates the disadvantages found in the conventional multi-bobbin wire coiling machines.

Another object of the present invention is to provide a multi-bobbin wire coiling machine which has a novel and improved jig mounting mechanism including jig support means each having a plurality of jigs secured thereto in vertically spaced relationship in the longitudinal direction of the associated jig support means.

According to one aspect of the present invention, the jig support means is in the form of a vertically movable slide plate.

According to another aspect of the present invention, the jig support means is in the form of a bar.

The above and other objects and attendant advantages of the present invention will be more readily apparent to those skilled in the art from a reading of the following detailed description in conjunction with the accompanying drawings in which preferred embodiments of the present invention and the prior art are shown for comparison for illustration purpose only, but not for limiting the scope of the invention thereto in any way.

PREFERRED EMBODIMENTS OF THE INVENTION

Figure 1:
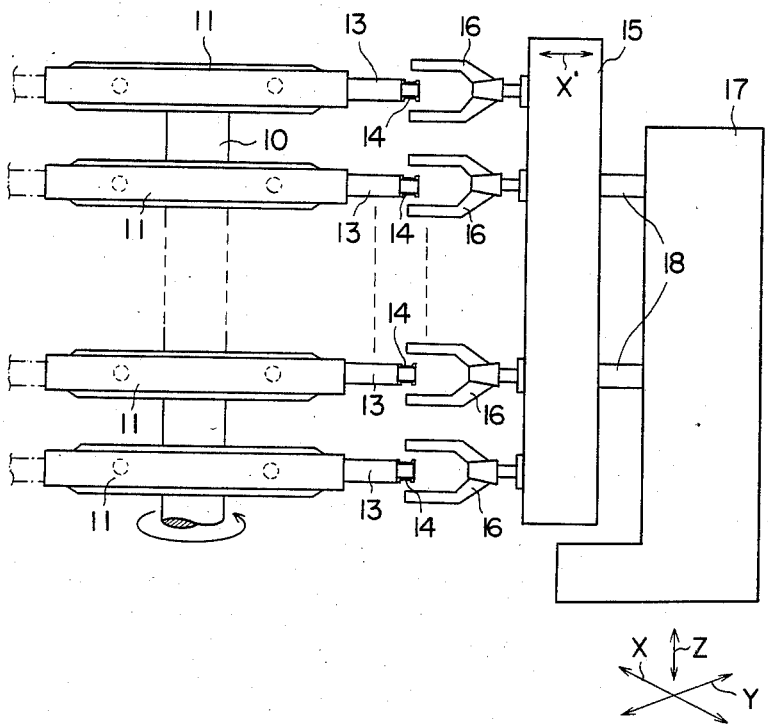
Fig. 1 PRIOR ART
FIG. 1 is a diagrammatic elevational view of a conventional multi-bobbin wire coiling machine.

Before explaining embodiments of the invention in detail, it is to be understood that the invention is not limited in its application to the details of the construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

For better understanding of the present invention, description will be first had on the conventional wire coiling machines referring to FIGS. 1 and 2 and FIGS. 4 and 5.

Figure 2:
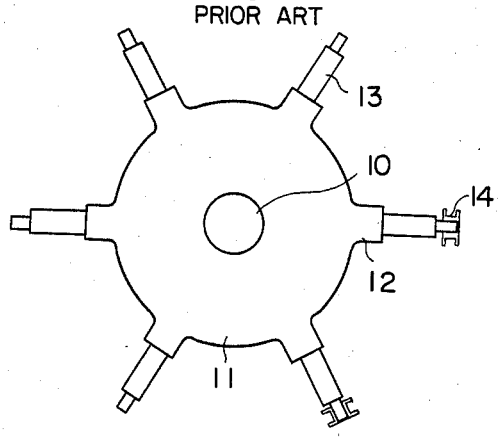
Fig. 2 PRIOR ART
FIG. 2 is a diagrammatic top plan view of the jig mounting mechanism in said wire coiling machine as shown in FIG. 1.

Reference is first made to FIGS. 1 and 2 in which one conventional wire coiling machine is diagrammatically shown. The wire coiling machine is designed to simultaneously coil a plurality of wires about a plurality of bobbins with one ends of the wires anchored to the associated bobbins. The wire coiling machine generally comprises a vertical rotary shaft 10 adapted to be intermittently rotated by a conventional drive means (not shown), a plurality of table-shaped indexing jig holders 11 mounted on the shaft 10 at different levels in the longitudinal direction of the shaft, each of the jig holders having a plurality of circumferentially spaced projections 12 extending radially outwardly from the periphery of the associated jig holder and having slots therein, a plurality of jigs 13 received in the slots in the associated projections and secured to the associated jig holder by bolts, a plurality of bobbins 14 mounted in the associated jigs, a flyer support head 15, a plurality of flyers 16 supported on the flyer support head surrounding the bobbins and a wire feed head 17 connected to the flyer support head 15 by means of connectors 18. The flyer support and wire feed head assembly 15, 17 is adapted to be moved in X, Y and Z directions. The wire feed head 17 serves as the support means for the flyer support head 15. In the multi-bobbin wire coiling machine in FIGS. 1 and 2, since the whole weight of the wire feed head 17 including its own weight and a load applied to the head is substantial, in order to move the head 17 in X, Y and Z directions, the drive means for moving the wire feed head 17 should be one having a high power. In a possible modification of the wire coiling machine of FIGS. 1 and 2, the flyer support head 15 is designed to move right and left as shown by the double arrow X' only in Y direction and the wire feed head 17 is designed to move in Y and Z directions. However, also in the modification, the drive source for moving the heads 15, 17 in the directions should be one having a high power which results in a large size machine and large associated parts. Particularly, when the wire feed head 17 is driven in Z direction, a high load is concentrated on the head.

When wires have been completely coiled about the bobbins 14 which are now positioned in the operative position or adjacent to the respectively associated flyers 16, the rotary shaft 10 is turned by a distance (60° in the machine of FIGS. 1 and 2) sufficient to cause the bobbin holders 11 to index the empty bobbins 14 which immediately follow the bobbins 14 about which the wires have been coiled in the rotational direction of the shaft 10 to the operative position or adjacent to the flyers 16.

Figure 3:
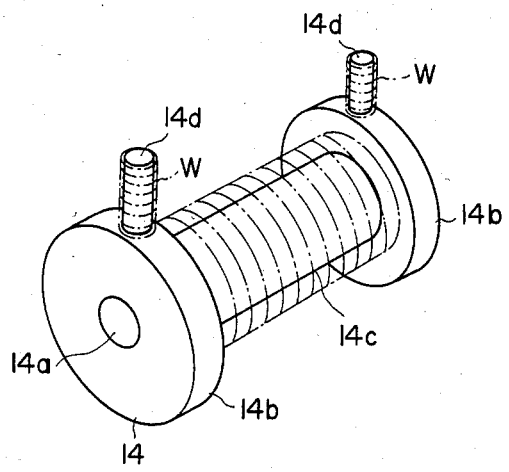
Fig. 3 PRIOR ART
FIG. 3 is a perspective view on an enlarged scale showing a typical manner in which a wire is coiled about a bobbin with one end anchored to the bobbin in a wire coiling machine.

FIG. 3 shows a typical manner in which wires are coiled about a bobbin with their one ends anchored to the bobbin 14. The bobbin 14 includes an axial through opening 14*a*, flanges 14*b* at the opposite ends of the body or drum 14*c* of the bobbin and anchoring cores 14*d* projecting uprightly from the tops of the associated flanges 14*b*. Reference character W denotes wires to be coiled about the cores 14*d* with their one ends anchored thereto.

Demand for coiled wire products has increased sharply of late and the coiled wire products are required to be tied up at the opposite ends. The thus produced coiled wire products are placed onto and secured to a printed substrate and electrically connected together to provide desired electronic parts.

Figure 4:
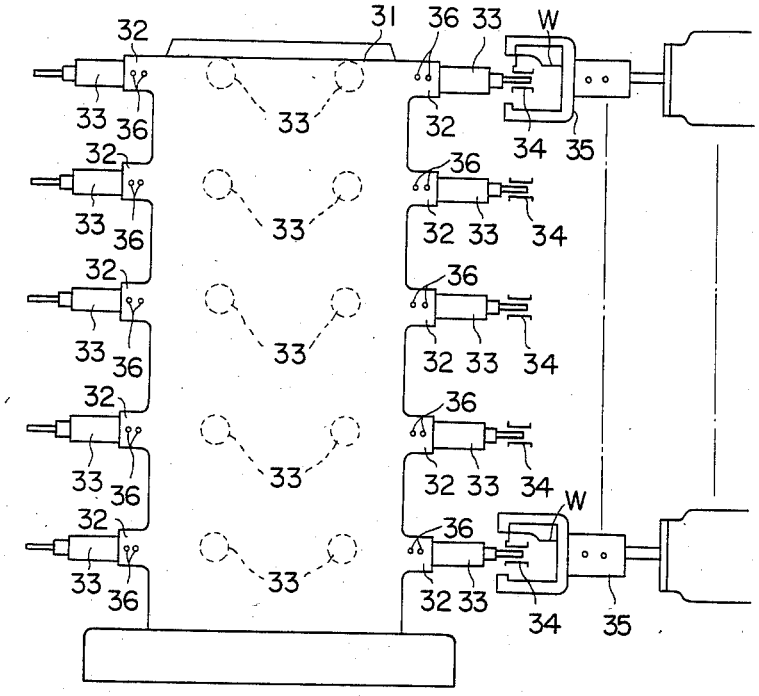
Fig. 4 PRIOR ART
FIG. 4 is a fragmentary diagrammatic elevational view of another conventional multi-bobbin wire coiling machine.
Figure 5:
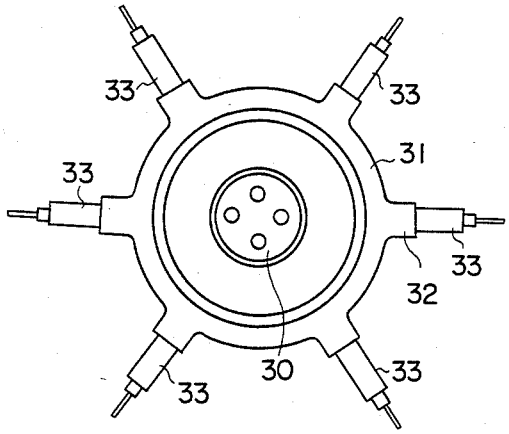
Fig. 5 PRIOR ART
FIG. 5 is a diagrammatic top plan view of the jig mounting mechanism in said wire coiling machine as shown in FIG. 4.

FIGS. 4 and 5 show another conventional wire coiling machine and the machine generally comprises a vertical rotary shaft 30 adapted to be intermittently rotated by a conventional drive means (not shown), a hollow cylindrical jig holder 31 mounted on the shaft for rotation therewith and having a plurality of slotted projections 32 radially outwardly extending from the periphery of the holder in circumferentially spaced relationship to each other at different levels in the longitudinal direction of the holder, a plurality of jigs 33 received in the slots of the associated projections, a plurality of bobbins 34 mounted in the jigs and a plurality of flyers 35 surrounding the bobbins and adapted to rotate at a high speed to coil wires W about the bobbins.

The jigs 33 are individually secured to the projections 32 by means of bolts 36. In the wire coiling machine of FIGS. 4 and 5, when the wires W have been completely coiled about the bobbins 34 which are now mounted in the jigs 33 and the bobbins having the wires coiled thereabout are to be replaced by new or empty bobbins, it is necessary that the existing jigs 33 be replaced by other jigs appropriate to the new bobbins. Such replacement operation is time consuming and tedium. Furthermore, the wire coiling machine of FIGS. 4 and 5 has the disadvantage that the points of attachment of the jigs 33 on the bobbin holder 31 should be individually adjusted.

Thus, the present invention has been developed to substantially reduce a load applied to the flyer support and wire feed head assembly as shown in FIGS. 1 and 2 when the assembly is driven in Z direction.

Furthermore, according to the present invention, there has been provided a novel and improved jig mounting mechanism for a multi-bobbin wire coiling machine which is substantially improved over the conventional jig mounting mechanism of the type referred to hereinabove, which ensures positive and precise attachment of bobbins and rapid replacement of bobbins and which enhances the mass-production operation of the multi-bobbin wire coiling machine in which the jig mounting mechanism is incorporated whereby high quality and reliable coiled wire products can be obtained.

Figure 6:
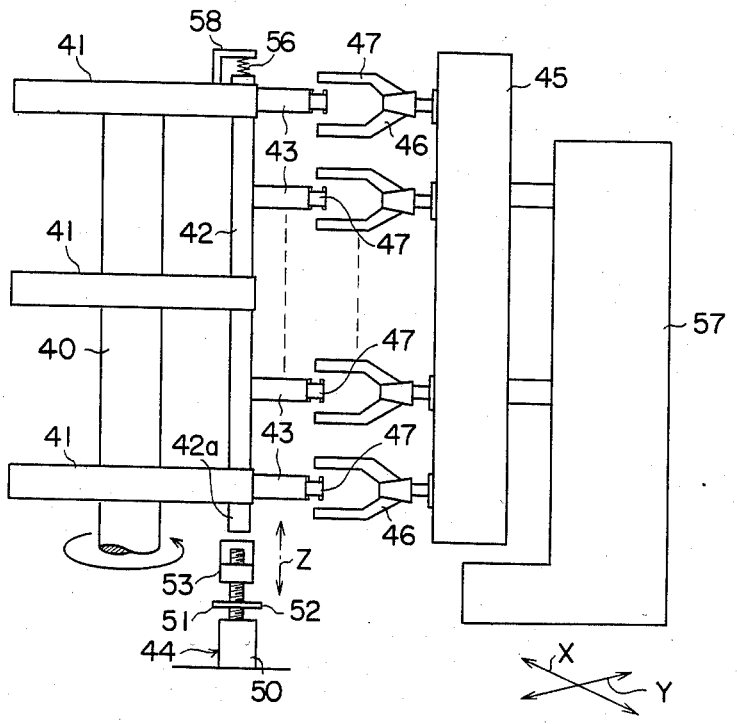
FIG. 6 is a diagrammatic elevational view of one embodiment of the multi-bobbin wire coiling machine constructed in accordance with the principle of the present invention.
Figure 7:
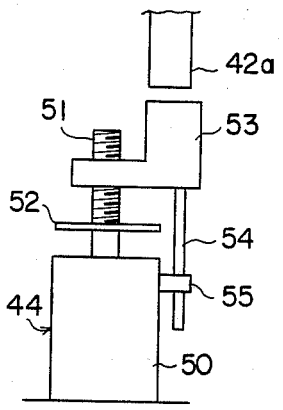
FIG. 7 is a fragmentary diagrammatic elevational view on an enlarged scale showing the relationship between the lower end portion of the slide plate and the pulse motor in the wire coiling machine as shown in FIG. 6.

The present invention will be now described referring to FIGS. 6, 7, 8 and 9 and more particularly, to FIGS. 6 and 7 thereof in which the first embodiment of the wire coiling machine of the invention is diagrammatically shown. The wire coiling machine generally comprises a vertical rotary shaft 40, a plurality of indexing jig holders 41 in the form of a table which includes a plurality of circumferentially spaced slots (not shown) formed about the periphery of the table, a plurality of vertically movable slide plates 42 (only one slide plate 42 is shown in FIG. 6) slidably received in the slots in the associated jig holders 41, each of the slide plates 42 having a plurality of bobbin mounting jigs 43 secured thereto by conventional means in vertically spaced relationship to each other in the longitudinal direction of the associated plate 42 and projecting outwardly therefrom, a drive means 44 positioned below a particular slide plate 42 for vertically moving the slide plate when the plate is indexed to the operative position, a flyer support head 45 having a plurality of vertically spaced flyers 46 rotatably supported thereon in surrounding the bobbins on the slide plate positioned in the operative position. Bobbins 47 are mounted in the respectively associated jigs 43 to be indexed in the manner as will be described hereinafter. The drive means 44 comprises a pulse motor 50 having an operation shaft in the form of a partially threaded rotary rod 51 extending uprightly therefrom, a ring-shaped sensor 52 mounted on the plain lower end portion of the rod 51 to detect any displacement amount in the rotation of the motor 50, an internally threaded L-shaped operation head 53 in threaded engagement with the rod 51 for upward or downward movement as the rod 51 rotates in one or the other direction and a detent 54 secured to one side of the motor 50 by means of a bracket 55 which is in turn secured to the one side of the motor and extending in parallel to the operation shaft 52. The operation head 53 is adapted to abut at the upper end against the lower end portion 42*a* of the slide plate 42 to move the slide plate 42 upwardly when the motor 50 is energized. An L-shaped anchor piece 58 is provided on the topmost jig holder 41 adjacent to each of the slide plates 42 and a spring 56 is anchored at the upper end to the anchor piece 58 and abuts at the lower end against the upper end of the associated slide plate 42 for normally biasing the slide plate 42 downwardly. Reference numeral 57 denotes a wire feed head connected to the flyer support head 45.

With the above-mentioned construction and arrangement of the components of the wire coiling machine of FIGS. 6 and 7, when wires are coiled about the bobbins 47 with their one ends anchored to the bobbins, the flyer support and wire feed head assembly 45, 57 is driven by a conventional drive means (not shown) in X and Y directions as shown in FIG. 6 to thereby cause the flyers 46 to rotate about the cores on the associated bobbins positioned in the operative position to coil the wires about the cores. While the flyer support and wire feed head assembly 45, 57 is performing the combined movement in X and Y directions, the slide plate 42 positioned in the operative position is moved upwardly and downwardly by the drive means 44 to thereby move the bobbins 47 on which the wire coiling is being performed.

Furthermore, the drive means 44 which imparts a vertical movement or movement in Z direction to the slide plate 42 indexed to the operative position or adjacent to the flyers 46 is disposed below the slide plate 42 in the operative position and when the operator senses when a particular slide plate 42 has reached the operative position by means of an electric or mechanical detection means known to those skilled in the art as the rotary shaft 40 and accordingly, the jig holders 41 mounted thereon are rotated, the pulse motor 50 of the drive means is energized to rotate the rod in the direction to cause the operation head 53 to abut against the slide plate 42. When the wires have been completely coiled about the bobbins 47 supported on the particular slide plate 42 in the operative position, the motor 50 is reversed in its rotational direction to lower the operation head 53 away from the slide plate 42 whereupon the spring 56 biases the slide plate 42 downwardly to a predetermined lowermost position in the vertical movement stroke of the slide plate 42 where the lower end portion 42*a* of the slide plate 42 is separated from the operation head. In this way, the rotary shaft 40 and accordingly, the indexing jig holders or tables 41 can be smoothly rotated by a predetermined angular distance sufficient to move the bobbins 47 having the wires coiled thereon out of the operative position and in turn index the bobbins 47 immediately following the first-mentioned bobbins to the operative position.

The driving of the wire feed head 57 in X direction may be effected by operating the flyer support head 45.

The engaging between the operation head 53 and the slide plate 42 may be effected by means of any arrangement other than the illustrated arrangement and for example, the lower end of the slide plate 42 may be formed with a dovetail groove to receive the operation head 53 therein within the scope of the present invention. In this way, the engagement arrangement between the operation head and the slide plate may be suitably selected by those skilled in the art as desired.

Furthermore, in the wire coiling machine as shown in FIGS. 6 and 7, although the bobbin mounting jigs 43 should be also replaced when the bobbins now attached to the jigs are to be replaced by bobbins of other types and/or sizes, if another slide plate (the slide plate itself is applicable to different types and/or sizes of jigs) having bobbins of different sizes and /or types previously attached thereto is in stock, the troublesome and inefficient replacement operation as experienced in the wire coiling machine as shown in FIGS. 1 and 2 is eliminated. In the conventional jig replacement, the jigs 13 are individually detached from the projections 12 on the associated jig holders 11 by loosening the set screws, new or different jigs 13 are inserted into the jig holder projections 12 and the screws are tightened. Thus, the jig replacement operation on the wire coiling machine of the invention can be rapidly performed. Although the wire coiling machine of FIGS. 6 and 7 is shown as having three jig holders 41 in vertically spaced relationship, the coiling machine may be provided with five jig holders 41 and in such a case, five jigs may be attached to each of the slide plates 42 to thereby substantially reduce the production cost of coiled wire products.

In the wire coiling machine as shown in FIGS. 6 and 7, the wire is guided to the flyer and payed out of a nozzle (not shown) to the bobbin to be coiled thereabout.

Since the wire coiling machine of the present invention has a jig mounting mechanism including vertically movable slide plates for driving the bobbins in the Z direction, the drive source employed for driving the bobbins in such a direction may be one having a power lower than that of the drive source required for driving the bobbins in the conventional wire coiling machines and thus, the entire wire coiling machine has a simpler and lighter construction.

Figure 8:
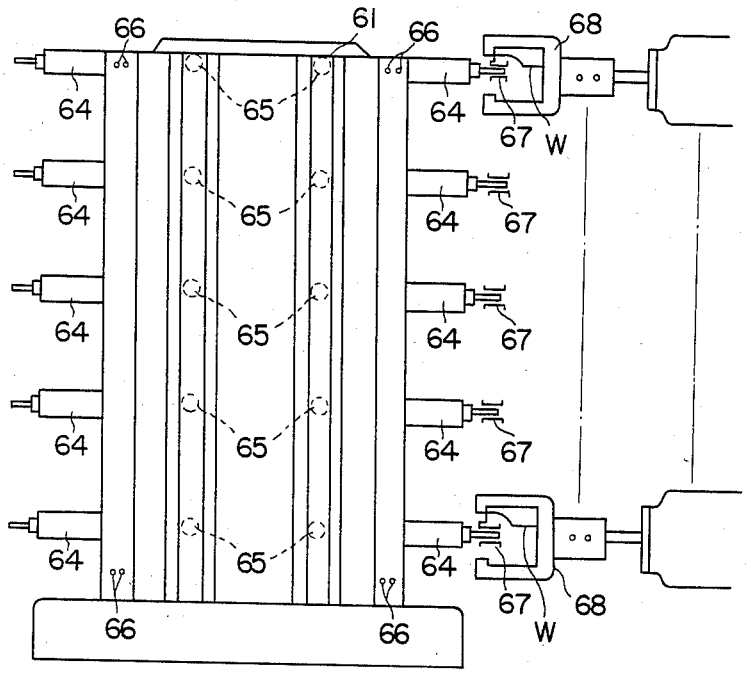
FIG. 8 is a diagrammatic elevational view of a modified embodiment of the wire coiling machine constructed in accordance with the principle of the present invention.
Figure 9:
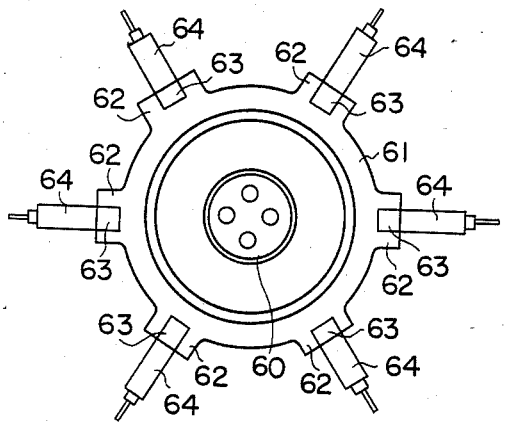
FIG. 9 is a diagrammatic top plan view of the jig mounting mechanism in said wire coiling machine as shown in FIG. 8.

Referring now to FIGS. 8 and 9 in which a modified embodiment of the jig mounting mechanism for the multi-bobbin wire coiling machine in accordance with the present invention is diagrammatically shown. The jig mounting mechanism generally comprises a vertical rotary shaft 60, a cylindrical indexing standard 61 mounted on the rotary shaft 60 for rotation therewith and having a plurality of circumferentially spaced slotted projections 62 extending radially outwardly from the periphery of the standard at different levels in the longitudinal direction thereof, a plurality of bars 63 received in the slots in the projections 62 and each having a plurality of arms 64 secured thereto in vertically spaced relationship to each other and a plurality of jigs 65 received in the arms 64. The jigs 65 are secured to the projections 62 on the indexing standard 61 by means of bolts 66. Reference numeral 67 denotes bobbins mounted in the jigs 65 and reference numeral 68 denotes flyers positioned in the operative position and adapted to coil wires W about the bobbins as the flyers are rotated. With the above-mentioned construction and arrangement of the components of the jig mounting mechanism, by attaching and removing one particular bar 64 to and from the cylindrical standard 61, all the arms 64 supported by the bar 63 can be attached to and removed from the standard at one time and accordingly, all the jigs 65 and bobbins 67 associated with one bar 63 can be simultaneously held on and removed from the indexing standard to thereby reduce the frequency of loosening and tightening of the bolts 66.

In operation, after a desired number of bobbins 67 have been held on the jig mounting mechanism in the manner as described just above, wires W are fed to the flyers 68 through tension arms (not shown). The number of turns to be formed in each wire to be coiled is set by a digital counter (not shown) to thereby complete the preparation for wire coiling. Thereafter, a start button (not shown) is depressed down to initiate the wire coiling operation on the wire coiling machine in which the jig mounting mechanism of the present invention is incorporated. The wire coiling operation starts at a relatively low speed and the speed increases gradually to a predetermined value. When the speed has reached the predetermined speed the predetermined speed is maintained until the coiling operation approaches the last stage of the operation whereafter the speed reduces gradually. when the predetermined number of turns have been formed in the wire, the machine ceases the operation. In this way, wires are simultaneously coiled about all the bobbins 67 which are then indexed to the operation position or adjacent to the flyers 68. Then the rotary shaft 60 is rotated to move the bobbins having the wires coiled thereabout out of the operative position and index the empty bobbins immediately following the first-mentioned bobbins to the operative position. By repeating the procedure, the wire coiling operation is in succession performed on the bobbins in the successive vertical rows.

As clear from the foregoing description on the improved jig mounting mechanism of FIGS. 8 and 9 for the multi-bobbin wire coiling machine, since a plurality of bobbin mounting jigs arranged in each vertical row in the periphery of the indexing standard are adapted to be simultaneously replaced, the bobbin replacement can be promptly and easily performed to thereby shorten the time required for bobbin replacement and enhance the bobbin replacement operation efficiency. Furthermore, when bars having mounting jigs for bobbins of different types and/or sizes attached thereto are in store, the bobbin mounting jigs of one type and/or size can be easily replaced by bobbin mounting jigs of another type and/or size whereby a variety of coiled wire products can be produced with high efficiency. Thus, the present invention substantially contributes to the multi-bobbin wire coiling machine art.

While preferred embodiments of the invention have been shown and described in detail, it will be understood that the same are for illustration purposes only and not to be taken as a definition of the invention, reference being had for this purpose to the appended claims.

I claim:

1. A wire coiling machine having flyers, comprising:

an intermittently rotatable vertical rotary shaft, an indexing jig mounting mechanism mounted on said shaft for rotation together with the shaft, a plurality of bobbin mounting jigs supported on said jig mounting mechanism in vertically spaced relationship to each other in the longitudinal direction of the jig mounting mechanism, and a drive means positioned below said jig mounting mechanism adjacent to said flyers to move said jigs vertically;

said indexing jig mounting mechanism comprising a plurality of tables mounted on said shaft in vertically spaced relationship to each other in the longitudinal direction of the shaft and each having a plurality of slots about the periphery thereof, and a plurality of slide plates extending within said slots in the tables and having said jigs secured thereto in vertically spaced relationship to each other in the longitudinal direction of the associated slide plate.

2. The wire coiling machine as set forth in claim 1, in which said drive means comprises a pulse motor, a partially threaded rod extending uprightly from said motor, a sensor mounted on an unthreaded portion of said rod, an internally threaded operation head in threaded engagement with said rod and adapted to abut against a lower end portion of one of said slide plates when said one slide plate is indexed to a position adjacent to said flyers for detecting a displacement amount in the rotation of said pulse motor and a detent secured to said pulse motor.

3. The wire coiling maching as set forth in claim 1, further including biasing means provided on the topmost table of said plurality of tables adjacent to each of said slide plates for normally urging the associated slide plate downwardly.

4. A wire coiling machine having flyers, comprising:

an intermittently rotatable jig-holding mechanism having a longitudinal axis about which said mechanism is rotatable;

a plurality of elongated bar members removably mounted to said rotatable mechanism and spaced about a circumferential portion of said rotatable mechanism;

a plurality of bobbin jigs mounted on each of said elongated bar members for receiving respective bobbins on which wire is to be coiled, said bobbin jigs being spaced along the length of said bar members in the longitudinal direction of said rotatable mechanism; and drive means for rotating said rotatable mechanism so as to cause respective bar members to be selectively in registration with said flyers for winding wires on bobbins mounted on said respective jigs.

5. A jig mounting mechanism as set forth in claim 4, wherein said rotatable mechanism comprises a plurality of slot means, and wherein said bar members are removably slidable in said slot means so as to be removably engagable with said rotatable mechanism.

6. A jig-mounting mechanism as set forth in claim 5, comprising a plurality of said slot means spaced about the circumferential portion of said rotatable mechanism, each of said slot means extending in the longitudinal direction of said rotatable mechanism.

7. The wire coiling machine as set forth in claim 4, further comprising means for moving said bar members vertically relative to said rotatable mechanism when a bar member is located adjacent said flyers.

8. The wire coiling machine as set forth in claim 6, further comprising means for removably fixing said bar members in position relative to said rotatable mechanism, said bar members being removable from said rotatable mechanism for removal of its associated bobbin mounting jigs as a unit from said rotatable mechanism.

* * * * *